US007552483B2

(12) United States Patent
Turner

(10) Patent No.: US 7,552,483 B2
(45) Date of Patent: Jun. 30, 2009

(54) ATHLETIC SOCK

(75) Inventor: John M. Turner, Buffalo, NY (US)

(73) Assignee: Gear Up Sports Worldwide Ltd., Buffalo, NY (US)

( * ) Notice: Subject to any disclaimer, the term of this patent is extended or adjusted under 35 U.S.C. 154(b) by 0 days.

(21) Appl. No.: 11/081,046

(22) Filed: Mar. 15, 2005

(65) Prior Publication Data

US 2006/0206987 A1 Sep. 21, 2006

(51) Int. Cl.
*A43B 17/00* (2006.01)

(52) U.S. Cl. ..... 2/239

(58) Field of Classification Search ..... 2/239–242, 2/409, 22, 69, 912, 920, 911; 66/169 R, 66/172 E, 178 R, 182, 178 A, 171; 36/50.5, 36/55, 114, 117.7, 117.8, 118.1, 51
See application file for complete search history.

(56) References Cited

U.S. PATENT DOCUMENTS

| | | | | | |
|---|---|---|---|---|---|
| 340,132 | A | * | 4/1886 | Loesner | 2/240 |
| 989,024 | A | * | 4/1911 | Moses | 2/240 |
| 1,693,141 | A | * | 11/1928 | Ducat | 2/240 |
| D80,129 | S | * | 12/1929 | LeVeque | D2/993 |
| 1,920,943 | A | * | 8/1933 | Thompson | 2/240 |
| 1,978,140 | A | * | 10/1934 | Miller | 36/45 |
| 2,008,936 | A | * | 7/1935 | Tait | 2/240 |
| 2,157,399 | A | * | 5/1939 | Cohn | 2/241 |
| 2,193,056 | A | * | 3/1940 | Burn | 2/239 |
| 2,343,477 | A | * | 3/1944 | Ross | 36/10 |
| 2,513,639 | A | * | 7/1950 | Goodman | 2/239 |
| 2,526,663 | A | * | 10/1950 | Holland | 2/239 |
| 2,700,161 | A | * | 1/1955 | Boyce | 2/240 |
| 2,805,424 | A | * | 9/1957 | Johnson, Jr. et al. | 2/240 |
| 2,814,807 | A | * | 12/1957 | Dollar | 2/239 |
| 3,975,929 | A | * | 8/1976 | Fregeolle | 602/63 |
| 4,198,834 | A | * | 4/1980 | Reid, Sr. | 66/172 E |
| 4,669,126 | A | * | 6/1987 | Jones | 2/22 |
| 4,675,915 | A | | 6/1987 | Siciliano | |
| 4,713,895 | A | * | 12/1987 | Vallieres | 36/1.5 |
| 5,020,164 | A | * | 6/1991 | Edwards | 2/239 |
| 5,095,548 | A | | 3/1992 | Chesebro, Jr. | |
| 5,157,791 | A | * | 10/1992 | Woodson et al. | 2/239 |
| D362,957 | S | * | 10/1995 | Lindaman | D2/993 |
| D364,500 | S | * | 11/1995 | Kluttz et al. | D2/980 |
| 5,509,282 | A | * | 4/1996 | Ferrell, Jr. | 66/188 |
| 5,575,013 | A | | 11/1996 | Kräck | |
| 5,575,014 | A | * | 11/1996 | Kane et al. | 2/239 |
| 5,575,015 | A | * | 11/1996 | Paris et al. | 2/240 |
| 5,653,128 | A | | 8/1997 | Warren, Jr. et al. | |
| D382,994 | S | * | 9/1997 | Kluttz et al. | D2/980 |
| 5,682,616 | A | * | 11/1997 | Pisano | 2/239 |
| 5,742,945 | A | * | 4/1998 | Lindaman | 2/239 |
| 5,774,898 | A | * | 7/1998 | Malpee | 2/239 |

(Continued)

*Primary Examiner*—Alissa L Hoey
(74) *Attorney, Agent, or Firm*—Phillips Lytle LLP

(57) ABSTRACT

An improved athletic sock (15) comprising a foot portion (16), a leg portion (18) extending upwardly from the foot portion and having an open end (20) and a cuff (19) at the open end, the cuff comprising an absorbent band (17), a notch (21) extending longitudinally from the open end down part of the leg portion, the notch defined by a left edge (22) and a right edge (23), and a detachable fastening portion (24) adapted and configured to restrain the right and left edges from moving apart when the fastening portion is in a fastened position.

17 Claims, 3 Drawing Sheets

U.S. PATENT DOCUMENTS 5,867,839 A 2/1999 Lawlor
5,898,948 A 5/1999 Kelly et al.
5,926,844 A * 7/1999 Bear ..... 2/22
5,987,778 A * 11/1999 Stoner ..... 36/1.5
6,032,296 A 3/2000 Kelly et al.
6,082,146 A 7/2000 Dahlgren
6,135,974 A * 10/2000 Matz ..... 602/62
6,173,452 B1 1/2001 Kelly et al.
6,199,217 B1 * 3/2001 Mooney ..... 2/240
6,209,141 B1 4/2001 Adeli
6,341,505 B1 1/2002 Dahlgren
6,378,139 B1 * 4/2002 Mazzaglia ..... 2/242
D461,045 S 8/2002 Warren, Jr.
6,536,051 B1 3/2003 Oh
6,606,750 B2 8/2003 Solwey
6,612,136 B2 * 9/2003 Roe ..... 66/178 R
6,708,348 B1 3/2004 Romay
6,805,681 B2 10/2004 Yokoyama
6,807,683 B2 * 10/2004 Williams ..... 2/239
6,871,516 B2 * 3/2005 Peeler et al. ..... 66/171
2002/0029405 A1 * 3/2002 Outwater ..... 2/239
2002/0095716 A1 7/2002 Solwey
2003/0033837 A1 2/2003 Higgins
2003/0230121 A1 12/2003 Yokoyama

* cited by examiner

ATHLETIC SOCK

TECHNICAL FIELD

The present invention relates generally to the field of athletic socks and, more particularly, to an athletic sock having a construction that reduces the accumulation of perspiration in and around the foot of the wearer.

BACKGROUND ART

With athletic socks known in the prior art it has been the practice to control moisture accumulation in the foot portion of the sock by using hydrophobic materials so that moisture generated by the foot of the wearer is wicked outwardly and away from the foot. In addition, it is known in the prior art that stand alone wrist, ankle and head sweatbands, such as those shown and described in U.S. Pat. No. 4,675,915, can be used to attempt to control perspiration resulting from physical activity. However, athletic socks presently found on the market do not address both perspiration that builds up in the foot from physical activity and perspiration that may migrate into the foot from the upper regions of the body. Accordingly, it would be beneficial to provide an athletic sock that is easy to put on and remove, that provides support to the ankle, and that controls and traps perspiration migrating from above the sock.

DISCLOSURE OF THE INVENTION

With parenthetical reference to the corresponding parts, portions or surfaces of the disclosed embodiment, merely for the purpose of illustration and not by way of limitation, the present invention provides an improved athletic sock (15) comprising a foot portion (16), a leg portion (18) extending upwardly from the foot portion and having an open end (20) and a cuff (19) at the open end, the cuff comprising an absorbent band (17), a notch (21) extending longitudinally from the open end down part of the leg portion, the notch defined by a left edge (22) and a right edge (23), and a detachable fastening portion (24) adapted and configured to restrain the right and left edges from moving apart when the fastening portion is in a fastened position. The notch may extend below the cuff, may be of a V-shaped configured, or may be of a U-shaped configuration. The left edge and right edge of the notch may be reinforced with a strip of fabric (25). The band may comprise cotton terrycloth and may have a width (33) in the range of about ½ inch to about 3 inches and a thickness (34) in the range of about ⅛ inch to about 1 inch. The fastening portion may comprise a first flap (26) attached to and extending from the left side of the notch and a second flap (28) attached to and extending from the right side of the notch. The first flap may have a surface with a hook (29) configuration and the second flap may have a surface with a loop (30) configuration compatible with the hook configuration. The leg portion may further comprise a liner (31) extending between the left and right edges of the notch and the liner may comprise a breathable fabric and may be configured and arranged such that the left and right edges of the notch may be separated so as to allow the sock to be easily pulled on to a user's foot. The cuff portion may further comprise an elastic band (32). The elastic band may have an end portion (35) and the end portion may form the second flap. The absorbent band and elastic band may be concentric and the absorbent band may be on the inside of the cuff portion and the elastic band may be on the outside of the cuff portion. A portion of the absorbent band may extend beyond one edge and may be supported by the end portion of the elastic band. The foot portion may comprise moisture-wicking fibers and/or antimicrobial acrylic cushioning.

Accordingly, the general object of the present invention is to provide an athletic sock which limits the amount of perspiration that accumulates in the foot portion of the sock.

Another object is to provide an athletic sock which has a barrier against moisture flowing down the leg of the user into the foot portion.

Another object is to provide an athletic sock which traps or absorbs moisture flowing down the leg of the user before it reaches the inside of the user's shoe.

Another object is to provide an athletic sock which includes a thick sweat band portion at the upper open end of the sock.

Another object is to provide an improved athletic sock which can be widened at the open end to allow the sock to be more easily slipped on and off the foot of the user.

Another object is to provide an athletic sock which has a cuff portion that can be maintained in a secure position on the user's lower leg.

Another object is to provide an athletic sock which has a cuff portion that can be adjusted to fit a variety of leg sizes.

These and other objects and advantages will become apparent from the foregoing and ongoing written specification, the drawings, and the appended claims.

DESCRIPTION OF THE PREFERRED EMBODIMENTS

Figure 1:
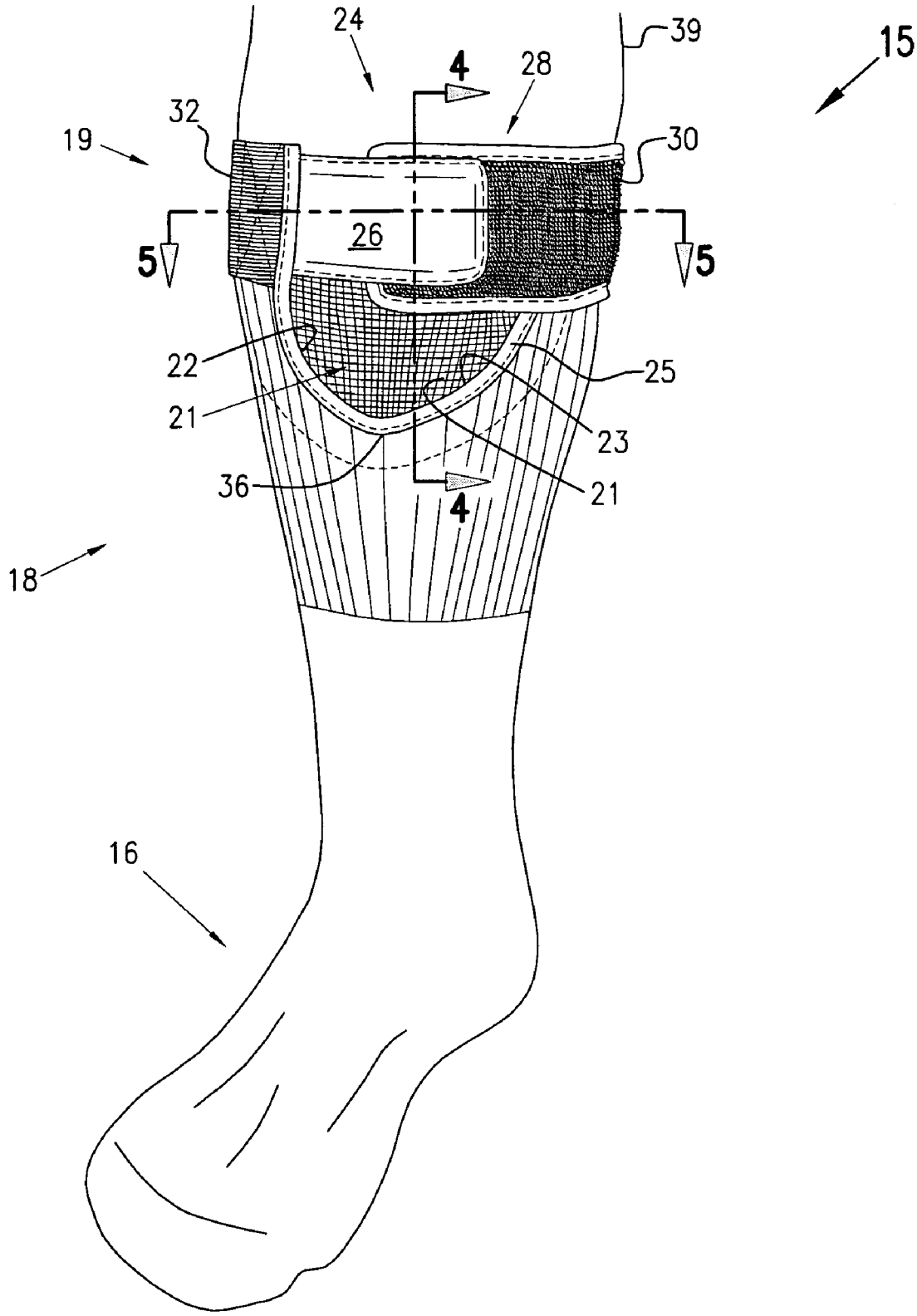
FIG. 1 is a perspective view of the improved athletic sock in a fastened position on the foot of a user.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
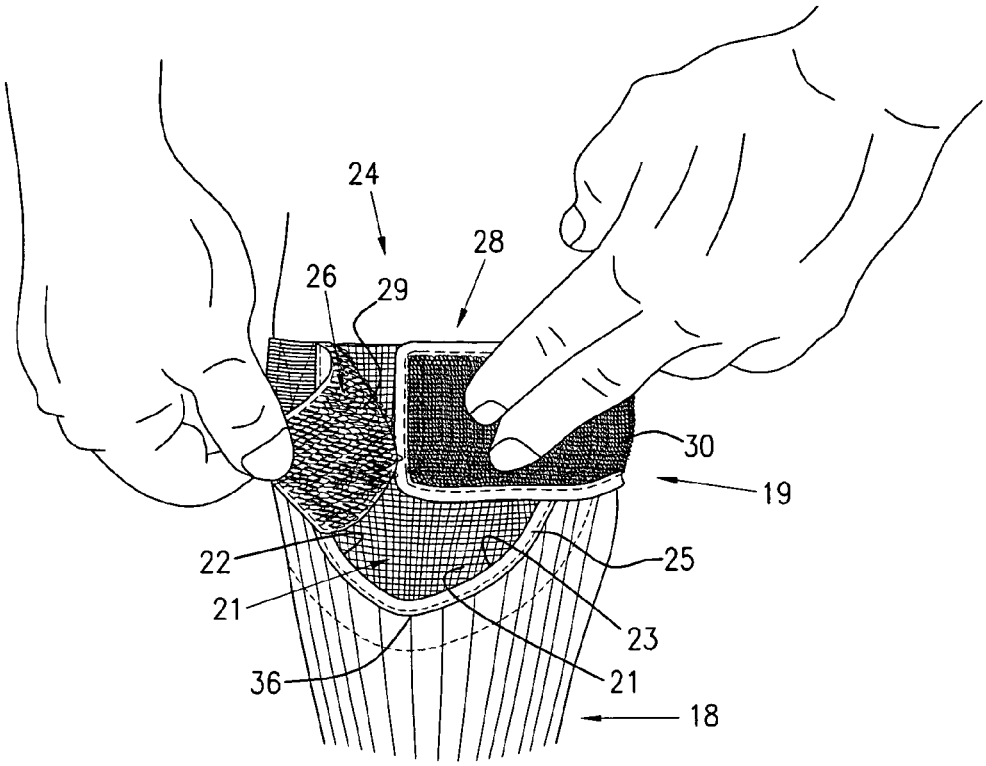
FIG. 2 is an enlarged perspective view of the upper leg portion of the sock shown in FIG. 1 being unfastened at the cuff portion by a user.
Figure 3:
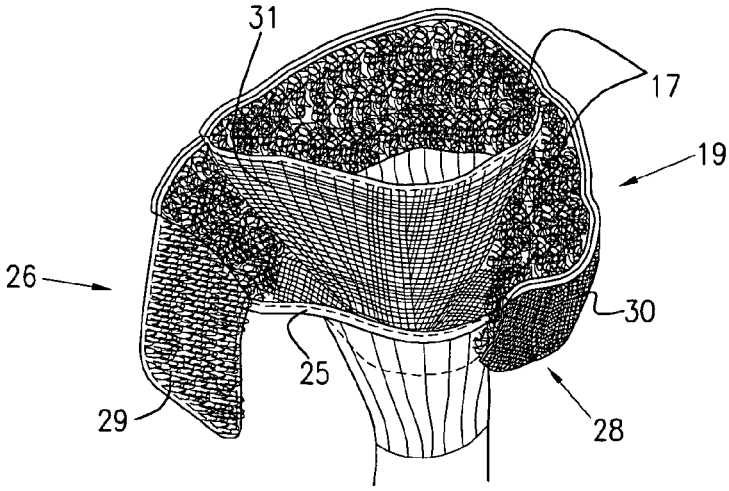
FIG. 3 is a top perspective view of the leg portion shown in FIG. 1 in an unfastened position.
Figure 4:
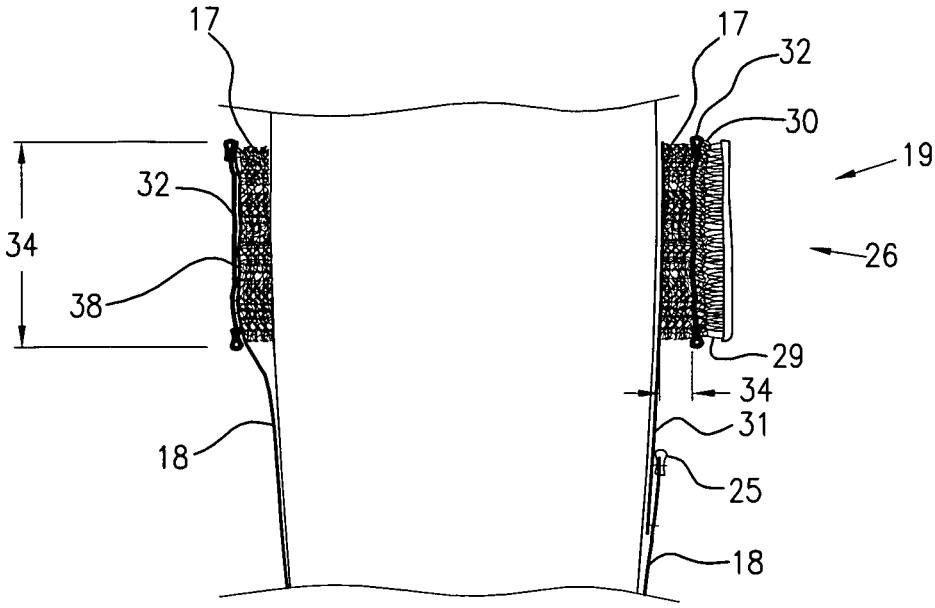
FIG. 4 is a partial vertical sectional view of the athletic sock shown in FIG. 1, taken generally on line 4-4 of FIG. 1.
Figure 5:
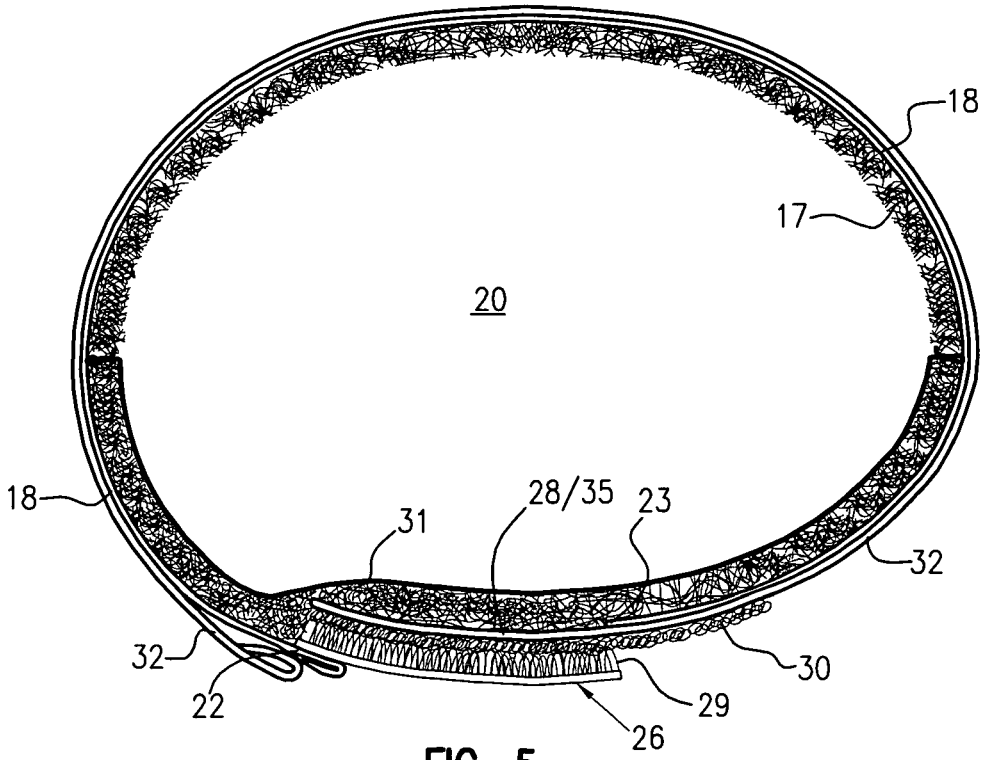
FIG. 5 is a horizontal sectional view of the athletic sock shown in FIG. 1, taken generally on line 5-5 of FIG. 1.

Referring now to the drawings and, more particularly, to FIG. 1 thereof, the present invention provides an improved athletic sock, the presently preferred embodiment of which is generally indicated at 15. As shown in FIGS. 1-3, athletic sock 15 generally comprises a foot portion 16 and a leg portion 18. Foot portion 16 is the lower portion of the sock that engages the foot of the user.

Leg portion 18 extends above the foot portion and engages the lower leg of the user. The top of leg portion 18 has an open end 20 and a specially configured cuff 19 adjacent to open end 20. The user inserts his or her foot through open end 20 in order to wear sock 15.

As shown, the upper part of leg portion 18 is cut longitudinally down the front from open end 20 down leg portion 18 to midpoint 36 on leg portion 18 below cuff 19, thereby forming notch 21 in leg portion 18. Notch 21 is defined by left edge 22, which extends from a point on the circumference of the open end 20 of cuff 19 to midpoint 36, and right edge 23, which extends from a point on the circumference of the open end 20 of cuff 19 to meet left edge 22 at midpoint 36. Edges 22 and 23 are reinforced with a strip of material 25 that is folded over the cut edges and sewn in place. This adds strength to the cut edges and keeps them from unraveling. Notch 21 divides upper leg portion 18 into a left side and a right side.

As shown in FIGS. 1-5, a specially configured cuff 19 is provided at the open end of leg portion 18. Cuff 19 is specially configured to provide a barrier against perspiration descending the user's leg. When worn, cuff 19 traps and absorbs such perspiration. In the preferred embodiment, cuff 19 comprises three concentric layers: an inner cotton terrycloth absorbent band 17, the end portion 38 of leg portion 18, and an outer elastic band 32. Absorbent band 17 is sewn to the inside of the end portion 38 of leg portion 18 and elastic band 32 is sewn to the outside of end 38 of leg portion 18. Elastic band 32 includes a portion 35 that extends beyond the right edge 23 of end 38 of leg portion 18 to form second flap 28, and absorbent band 17 is also continued beyond right edge 23 with portion 35 and is thereafter attached directly to the inside surface of portion 35 of band 32.

In the preferred embodiment, absorbent band 17 is cotton terrycloth, which has advantageous moisture absorbing properties. However, it is contemplated that other absorbent materials may be used. Absorbent band 17 has a width 33 of between about ½ inch and about 3 inches, and preferably a width of about 2 inches. Absorbent band has a thickness 34 between about ⅛ inch and about 1 inch, and preferably a thickness of about ¼ inch. Absorbent band 17 is positioned such that at least a portion of the material will encircle at least a portion of the user's leg and such that the inner surface of such material will be in contact with such portion of the user's leg. While absorbent band 17 is shown as extending around the entire leg of user 39 when in a fastened position, it is contemplated that band 17 may not entirely encircle the leg when fastened, but may extend around only a portion of the circumference of the leg.

Elastic band 32 is formed of an elastic material having a predetermined range of elasticity so as to provide support to cuff 19 for a variety of sized legs and activities without significantly reducing blood circulation in the user's leg. Such material may be found in the waistband of many types of athletic supports. The width of elastic band 32 is about the same as the width of absorbent band 17. The elasticity of elastic band 35 allows for the sock to be put on to the user's foot and cuff 19 to be tightened to securely engage the lower leg portion of the user, even when the lower legs circumference changes due to muscle flexure and other activity. While elastic band 32 is shown as extending around the entire leg of user 39 when in a fastened position, band 32 may not entirely encircle the leg when fastened, but may extend around only a portion of the circumference of the leg. As used herein, "band" is meant to include, without limitation, a strip or length of material that extends only a portion of the way around the circumference of the open end of sock 15.

As shown, cuff 19 is held tightened around the lower leg of user 39 by fastening portion 24, which comprises two Velcro® straps. FIG. 1 shows cuff 19 in a fastened position. As shown, fastener 24 includes a first tab or flap 26 on the left side and a second tab or flap 28 on the right side. First flap 26 is sewn to the left edge or side of leg portion 18 and extends to the right beyond left edge 22. The inside surface of first flap 26 has multiple hooks 29. Second flap 28 is formed from the extension of end portion 35 of elastic band 32 to the left beyond the right edge 23 of leg portion 18. As shown in FIG. 3, the outer surface of end portion 35 of elastic band 32, which forms second flap 28, has multiple loops 30 which attach to hooks 29 on first flap 26. In the preferred embodiment, these loops 30 also extend along a part of the outside surface of elastic band 32 a distance beyond and to the right of right edge 23. This allows for a range of adjustment in the tightness of the cuff around a user's leg. Also, this type of adjustable hook and loop attachment permits the cuff to be detachably secured to a variety of leg sizes tightly enough to allow absorbent band 17 to trap and absorb moisture before it enters the user's shoe.

As shown in FIG. 2, sock 15 may be removed by separating first flap 26 from second flap 28. In particular, the inside surface of first flap 26 is peeled back by hand from the outside surface of second flap 25, thereby disengaging hooks 29 from loops 30. Once flaps 26 and 28 are disengaged, the left edge 22 and right edge 23 of leg portion 18 may be moved apart and, with cuff 19 of sock 15 fully loosened, the foot easily withdrawn from the sock or easily reinserted into the sock.

As shown in FIG. 3, a liner 31 is sewn to the inside of leg portion 18 between the left side and right side of leg portion 18. Liner 31 is a breathable fabric which permits airflow through it. Notch 21 and liner 31 thereby provide a certain amount of ventilation. Circulating air helps evaporate excess moisture and cools the lower leg and ankle of user 39 by permitting the easy dissipation of excess heat.

In the preferred embodiment, sock 15 is manufactured in a series of steps. A conventional sock is knitted on a sock knitting machine. Using a conventional cut and sew process, leg portion 18 is then slit or cut longitudinally down the front center to form notch 21. Reinforcement strip 25 is then folded over and sewn to cover the left edge 22 and right edge 23 of leg portion 18. A stretchable elastic strip 32 is pulled from a roll, measured, cut and then sewn as a band around the top outside end 38 of leg portion 18. End portion 35 of band 32 is provided so that it extends beyond the upper right edge 23 of leg portion 18 to form second flap 28. A terrycloth cotton strip 17 is pulled from a roll, measured, cut and then sewn as a band around the top inside end portion 38 of leg portion 18 and the inside surface of end portion 35 of band 32. A piece of breathable fabric is then cut and sewn on the inside between the cut edges of notch 21 to form liner 31. A patch of Velcro® hooks 29 are then sewn to the inside surface of first flap 26 and a patch of corresponding Velcro® loops are sewn to the outside surface of end portion 35 of elastic band 32, which forms second flap 28, and partly along band 32 to the right of edge 23. The Velcro® and flaps 26 and 28 are positioned so that, when disengaged, the notched portion of leg portion 18 will fold open to allow user 39 to easily slide his or her foot into the sock, at which point the flaps may be pulled together so they overlap to such an extent and elastic band 32 is stretched to such an extent that cuff 19 is held snuggly around the user's leg.

Cuff 19, with inner cotton layer 17, end portion 38 and outer elastic layer 35, when wrapped securely around the user's lower leg and held in place by Velcro® flaps 26 and 28, provides a barrier to moisture descending from the upper portion of the user's leg. This barrier helps to keep moisture from flowing into the sock and accumulating in the user's shoe.

Foot portion 16 of athletic sock 15 can be configured with a number of moisture control, cushioning and/or support features. For example, an antimicrobial acrylic cushion may be added as padding at the heal and/or front portion of the foot portion to reduce impact on the foot of the user. Antimicrobial material is injected into acrylic fibers during the spinning process and are bonded to the acrylic molecular structure. This provides a permit antimicrobial function that inhibits fungi, bacterial and/or yeast growth in the sock. In the preferred embodiment, the anti-microbial compound triclosan is used, which inhibits the growth of a broad range of bacteria, fungi and yeast. Besides inhibiting growth of bacteria, fungi and yeast, this system provides antibacterial properties which do not wash out when the sock is laundered, and using acrylic fibers helps wick away moisture.

In addition, foot portion 16 includes conventional moisture control wicking fibers. Coolmax® synthetic fibers, manufactured by Dupont, may be used in the preferred embodiment. It has been found that such fibers dry quickly and wick moisture away from the foot in a highly efficient manner. In addition, such fibers help keep the user's foot cool by drawing heat-generated moisture away from the skin.

Ribbed arch supports may be provided in foot portion 16 to prevent sock slippage. Such a ribbed arch has been shown to support the arch of the foot and to help keep the sock from slipping against the foot. Finally, the bottom of foot portion 16 may include a PVC coating, which helps to keep the foot in place.

The present invention contemplates that many changes and modifications may be made. Therefore, while the presently preferred form of the athletic sock has been shown and described, and several modifications discussed, persons skilled in this art will readily appreciate that various additional changes and modifications may be made without departing from the spirit of the invention, as defined and differentiated by the following claims.

What is claimed is:

1. An athletic sock comprising:

a foot portion;

a leg portion extending upwardly from said foot portion and having an open-end and a cuff portion adjacent said open end;

an elastic band attached and concentric to said cuff portion and adapted to encircle a lower leg of a user;

an absorbent band inner to said elastic band and attached and concentric to said cuff portion and adapted to encircle said lower leg of said user;

said cuff portion between said elastic band and said absorbent band;

each of said elastic band and said absorbent band extending longitudinally only partially down said leg portion;

a notch extending longitudinally from said open end down at least a part of said leg portion, said notch defined by a left edge and a right edge; and a detachable fastening portion adapted and configured to restrain said right and left edges from moving apart when said fastening portion is in a fastened position.

2. The athletic sock set forth in claim 1, wherein said notch extends below said cuff.

3. The athletic sock set forth in claim 1, wherein said notch is of a V-shaped configuration.

4. The athletic sock set forth in claim 1, wherein said notch is of a U-shaped configuration.

5. The athletic sock set forth in claim 1, wherein said left edge and said right edge of said edges are reinforced with a strip of fabric.

6. The athletic sock set forth in claim 1, wherein said absorbent band has a width in the range of about ½ inch to about 3 inches and has a thickness in the range of about ¼ inch to about 1 inch.

7. The athletic sock set forth in claim 1, wherein said fastening portion comprises a first flap attached to and extending from a left side of said notch and a second flap attached to and extending from a right side of said notch.

8. The athletic sock set forth in claim 7, wherein said first flap has a surface with a hook configuration and said second flap has a surface with a loop configuration compatible with said hook configuration.

9. The athletic sock set forth in claim 7, wherein said elastic band has an end portion and said second flap comprises said end portion comprises a second flap.

10. The athletic sock set forth in claim 1, wherein said leg portion further comprises a liner extending between said left and right edges of said notch.

11. The athletic sock set forth claim 10, wherein said liner comprises a breathable fabric.

12. The athletic sock set forth in claim 10, wherein said liner is configured and arranged such that said left and right edges may be separated apart to allow for the sock to be easily pulled on to a user's foot.

13. The athletic sock set forth in claim 1, wherein said foot portion comprises moisture-wicking fibers.

14. The athletic sock set forth in claim 1, wherein said notch extends from said open end down said leg portion to a point on said leg portion.

15. An athletic sock comprising:

a foot portion;

a leg portion extending upwardly from said foot portion and having an open-end and a cuff portion adjacent said open end;

an elastic band attached to said cuff portion and adapted to encircle a lower leg of a user;

a cotton terrycloth absorbent band inner to said elastic band and attached to said cuff portion and adapted to encircle said lower leg of said user;

each of said elastic band and said absorbent band extending longitudinally only partially down said leg portion;

a notch extending longitudinally from said open end down at least a part of said lea portion, said notch defined by a left edge and a right edge; and a detachable fastening portion adapted and configured to restrain said right and left edges from moving apart when said fastening portion is in a fastened position.

16. An athletic sock comprising:

a foot portion;

a leg portion extending upwardly from said foot portion and having an open-end and a cuff portion adjacent said open end;

an elastic band attached to said cuff portion and adapted to encircle a lower leg of a user;

an absorbent band inner to said elastic band and attached to said cuff portion and adapted to encircle said lower leg of said user;

each of said elastic band and said absorbent band extending longitudinally only partially down said leg portion;

a notch extending longitudinally from said open end down at least a part of said leg portion, said notch defined by a left edge and a right edge;

a detachable fastening portion adapted and configured to restrain said right and left edges from moving apart when said fastening portion is in a fastened position; and wherein a portion of said absorbent band extends beyond at least one of said edges of said notch and is supported by an said end portion of said elastic band.

17. An athletic sock comprising:

a foot portion comprising antimicrobial cushioning;

a leg portion extending upwardly from said foot portion and having an open-end and a cuff portion adjacent said open end:

an elastic band attached to said cuff portion and adapted to encircle a lower leg of a user:

an absorbent band inner to said elastic band and attached to said cuff portion and adapted to encircle said lower leg of said user:

each of said elastic band and said absorbent band extending longitudinally only partially down said leg portion:

a notch extending longitudinally from said open end down at least a part of said leg portion, said notch defined by a left edge and a right edge; and a detachable fastening portion adapted and configured to restrain said right and left edges from moving apart when said fastening portion is in a fastened position.

* * * * *